US008708292B2

(12) United States Patent
Koh

(10) Patent No.: US 8,708,292 B2
(45) Date of Patent: Apr. 29, 2014

(54) TABLE LEG ASSEMBLY

(76) Inventor: Tuang Hock Koh, Taichung (TW)

( * ) Notice: Subject to any disclaimer, the term of this patent is extended or adjusted under 35 U.S.C. 154(b) by 27 days.

(21) Appl. No.: 13/558,349

(22) Filed: Jul. 26, 2012

(65) Prior Publication Data

US 2012/0286111 A1 Nov. 15, 2012

Related U.S. Application Data

(63) Continuation-in-part of application No. 12/353,985, filed on Jan. 15, 2009, now abandoned.

(51) Int. Cl.
*A47B 91/00* (2006.01)

(52) U.S. Cl.
USPC ..... 248/188.7; 248/188.6; 248/167; 403/92; 403/93; 108/190

(58) Field of Classification Search
USPC ..... 248/167, 166, 188, 168, 170, 173, 436, 248/188.6, 186.1, 188.7, 289.11, 477, 479, 248/284.1, 282.12, 186.2; 403/92, 93, 94, 403/103, 353, 107, 106, 108; 108/186, 108/153.1, 158, 158.11, 19; 16/35 R
See application file for complete search history.

(56) References Cited

U.S. PATENT DOCUMENTS

| | | | | | |
|---|---|---|---|---|---|
| 3,877,669 | A * | 4/1975 | Ambasz | 248/188.7 |
| 4,178,858 | A * | 12/1979 | Ponzellini | 108/150 |
| 4,339,844 | A * | 7/1982 | Shatters | 16/82 |
| 4,511,108 | A * | 4/1985 | Ponzellini | 248/188.7 |
| 4,881,843 | A * | 11/1989 | Randleman | 403/92 |
| 5,205,223 | A * | 4/1993 | Ball et al. | 108/124 |
| 5,458,020 | A * | 10/1995 | Wang | 74/527 |
| 5,909,864 | A * | 6/1999 | Wang | 248/289.11 |
| 6,024,024 | A * | 2/2000 | Favaretto | 108/64 |
| 6,092,778 | A * | 7/2000 | Lang et al. | 248/478 |
| 6,196,568 | B1 * | 3/2001 | Stevens | 280/304.1 |
| 6,338,587 | B1 * | 1/2002 | Kuo | 403/109.7 |
| 7,971,822 | B1 * | 7/2011 | Crow | 242/591 |

* cited by examiner

*Primary Examiner* — Kimberly Wood

(57) ABSTRACT

A table leg assembly includes an upright leg and two branch legs. The upright leg has two tubes longitudinally extended therefrom. Each tube has a joint member disposed in a lower end thereof. Each branch leg has a cylinder formed at one end thereof. The cylinder is coaxially aligned with the respective tube. The cylinder of the respective branch leg has a ring disposed on a top thereof. The ring has a plurality of positioning grooves defined in an inner periphery thereof. At least one positioning pin passing through the joint member and positioned in one of the positioning grooves of the respective ring so as to restrict the respective branch leg in a certain angle.

4 Claims, 8 Drawing Sheets

TABLE LEG ASSEMBLY

CROSS-REFERENCE TO RELATED APPLICATION

This application is a Continuation-In-Part application of Ser. No. 12/353,985, filed 15 Jan. 2009, and entitled "TABLE LEG ASSEMBLY", now pending.

BACKGROUND OF THE INVENTION

1. Field of the Invention

The present invention relates to a table, and more particularly to a table leg assembly.

2. Description of Related Art

A conventional table leg assembly in accordance with the prior art comprises an upright leg and a branch leg connected to the upright leg. The upright leg is adapted to be mounted to a tabletop. The branch leg is substantially perpendicular to the upright leg to stabilize the table. The middle of the branch leg has a plug slot for receiving the upright leg. A screw passes the middle of the branch leg and fastens with the upright leg.

The conventional branch leg has a determinate length and width for supporting the table and stabilizing the table. The longer and wider branch leg may provide more stability; however, the length and the width are limited due to the placing environment. Furthermore, the longer and wider branch leg increase the production cost.

The present invention has arisen to mitigate and/or obviate the disadvantages of the conventional table leg assembly.

SUMMARY OF THE INVENTION

The main objective of the present invention is to provide an improved table leg assembly.

To achieve the objective, a table leg assembly comprises an upright leg having two tubes longitudinally extended therefrom, each tube having a joint member plugged into a lower end thereof, at least one positioning pin passed through the joint member, two branch legs connected to the upright leg, each branch leg having a cylinder formed in one end thereof, the cylinder being coaxially connected to the tube, a ring disposed on a top of the cylinder, the ring having multiple positioning holes defined therein, two connecting pins, each connecting pin passed through the cylinder and the ring and plugged into the joint member for firmly connecting the branch leg and the tube. Wherein, the joint member has a stub extended therefrom, the stub passing through the ring and plugged into the cylinder; the cylinder has a receiving hole centrally defined therein for receiving the stub; the table leg assembly further comprises a joint plate disposed in a bottom of the cylinder and two screws, each screw passed the joint plate and fastened with one of the two connecting pins for securing the two branch legs; each branch leg has a roller disposed in one end thereof opposite to the cylinder.

Under this arrangement, the at least one positioning pin is corresponding to one of the multiple positioning holes and plugged into the corresponding one of the multiple positioning holes.

Further benefits and advantages of the present invention will become apparent after a careful reading of the detailed description with appropriate reference to the accompanying drawings.

DETAILED DESCRIPTION OF THE INVENTION

Figure 1:
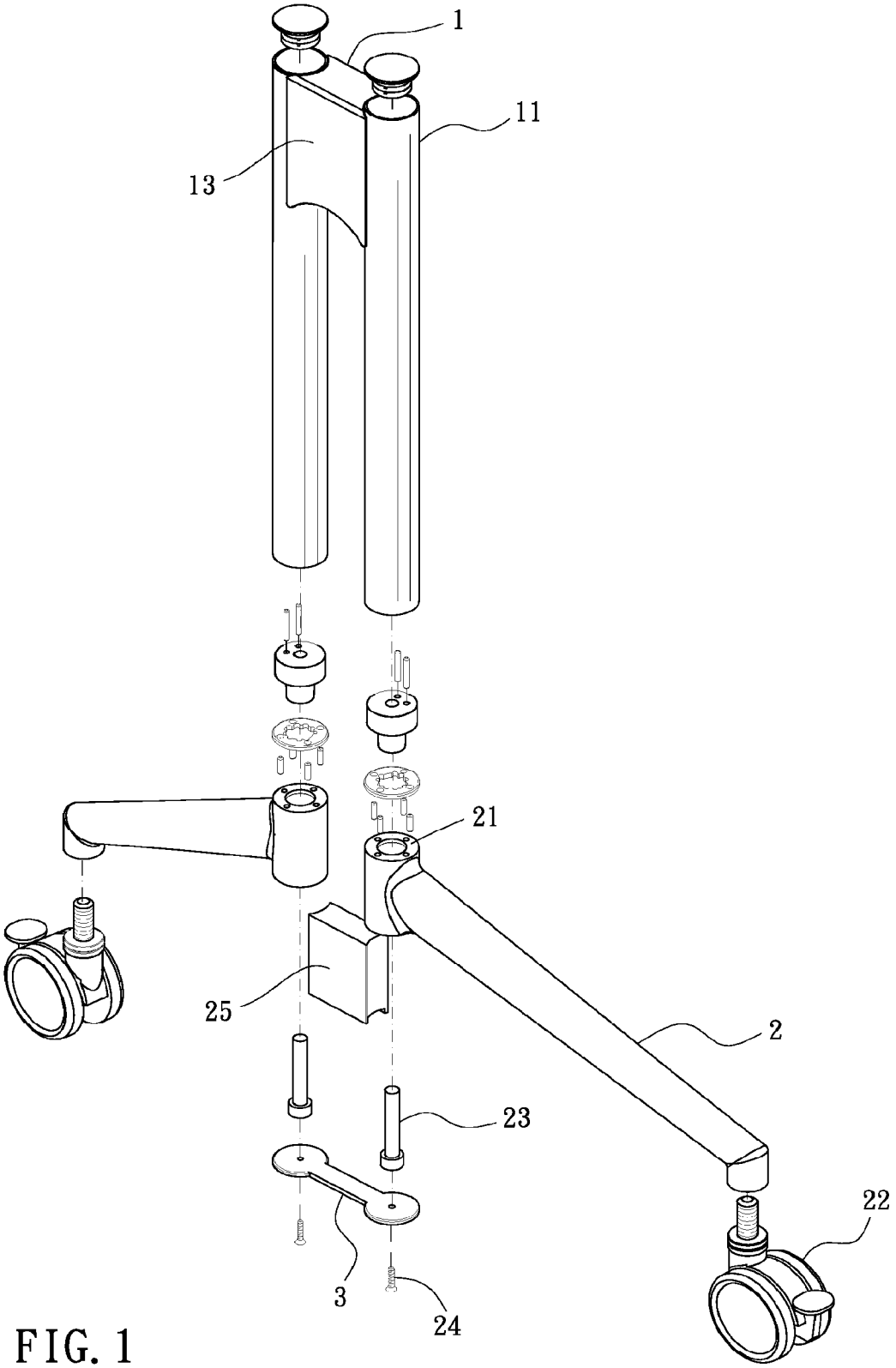
FIG. 1 is an exploded perspective view of a table leg assembly in accordance with the present invention.
Figure 2:
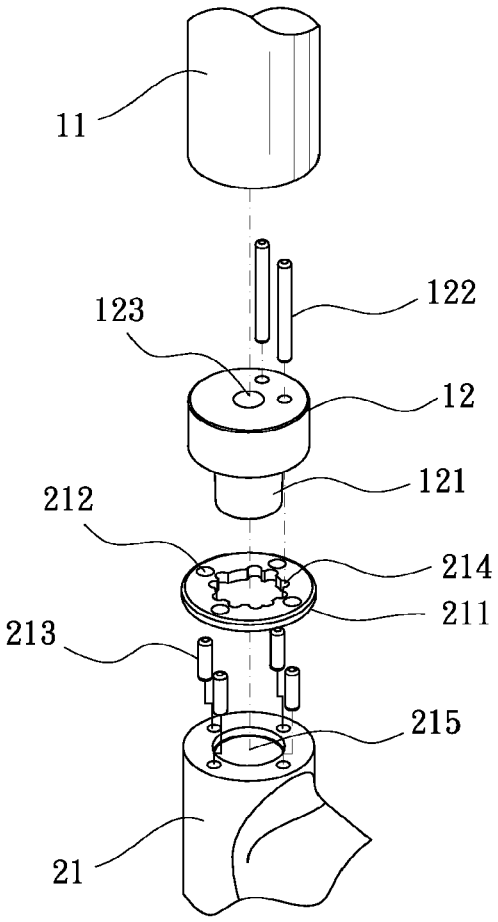
FIG. 2 is a partial enlarged exploded perspective view of the table leg assembly in accordance with the present invention.
Figure 3:
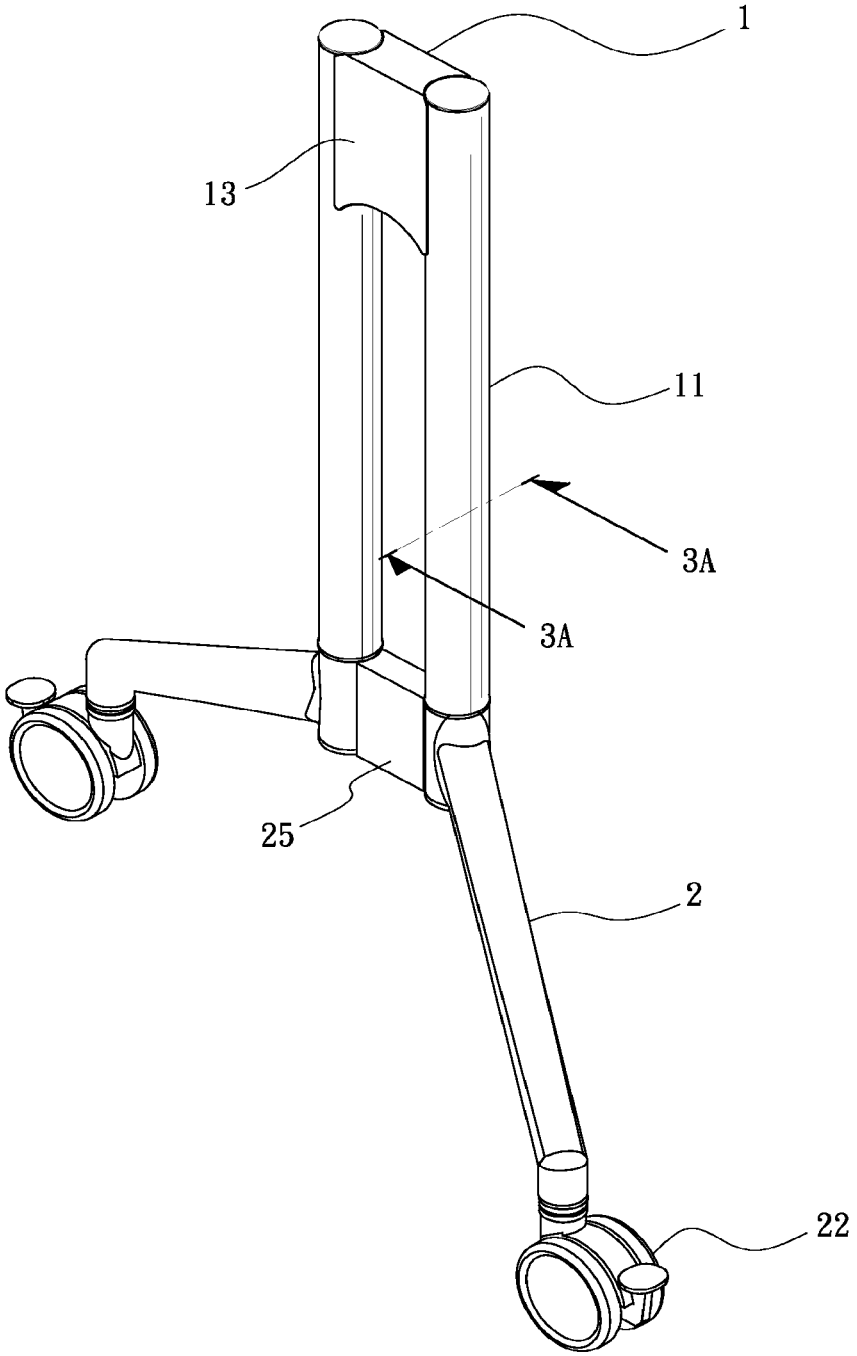
FIG. 3 is an assembled view of the table leg assembly in accordance with the present invention.

Referring to the drawings and initially to FIGS. 1-3, a table leg assembly in accordance with the present invention comprises an upright leg 1 and two branch legs 2 connected to the upright leg 1.

The upright leg 1 has two tubes 11 longitudinally extended therefrom. Each tube 11 is hollow. Each tube 11 has a joint member 12 plugged into a lower end of each tube 11. The joint member 12 has a post 121 centrally extended therefrom. The joint member 12 has a through hole 123 centrally defined therein. Each branch leg 2 has a cylinder 21 disposed in one end thereof for receiving the post 121 such that the cylinder 21 is coaxially connected to the respective tube 11. The other end of each branch leg 2 has a roller 22. The cylinder 21 of each branch leg 2 has a ring 211 positioned on a top of the cylinder 21. The ring 211 has a plurality of through holes 212 annularly defined therein. Specifically, a plurality of pins 213 is inserted in the through holes 212 of the ring 211 and the top of the cylinder 21 of the respective branch leg 2 for securing the ring 211 on the top of the cylinder 21. The cylinder 21 has a receiving hole 215 centrally defined therein for receiving the post 121 of the joint member 12. As shown in FIG. 2 and referring to FIG. 3A, the post 121 of the joint member 12 passes through the ring 211 and is received in the receiving hole 215 of the cylinder 21 so that each branch leg 2 could be pivoted relative to the post 121. The ring 211 has a plurality of positioning grooves 214 defined around an inner periphery thereof. At least one positioning pin 122 passes through the joint member 12. The positioning pin 122 is corresponding to and positioned in one of the positioning grooves 214 so as to restrict the respective branch leg 2 in a certain angle.

Figure 3A:
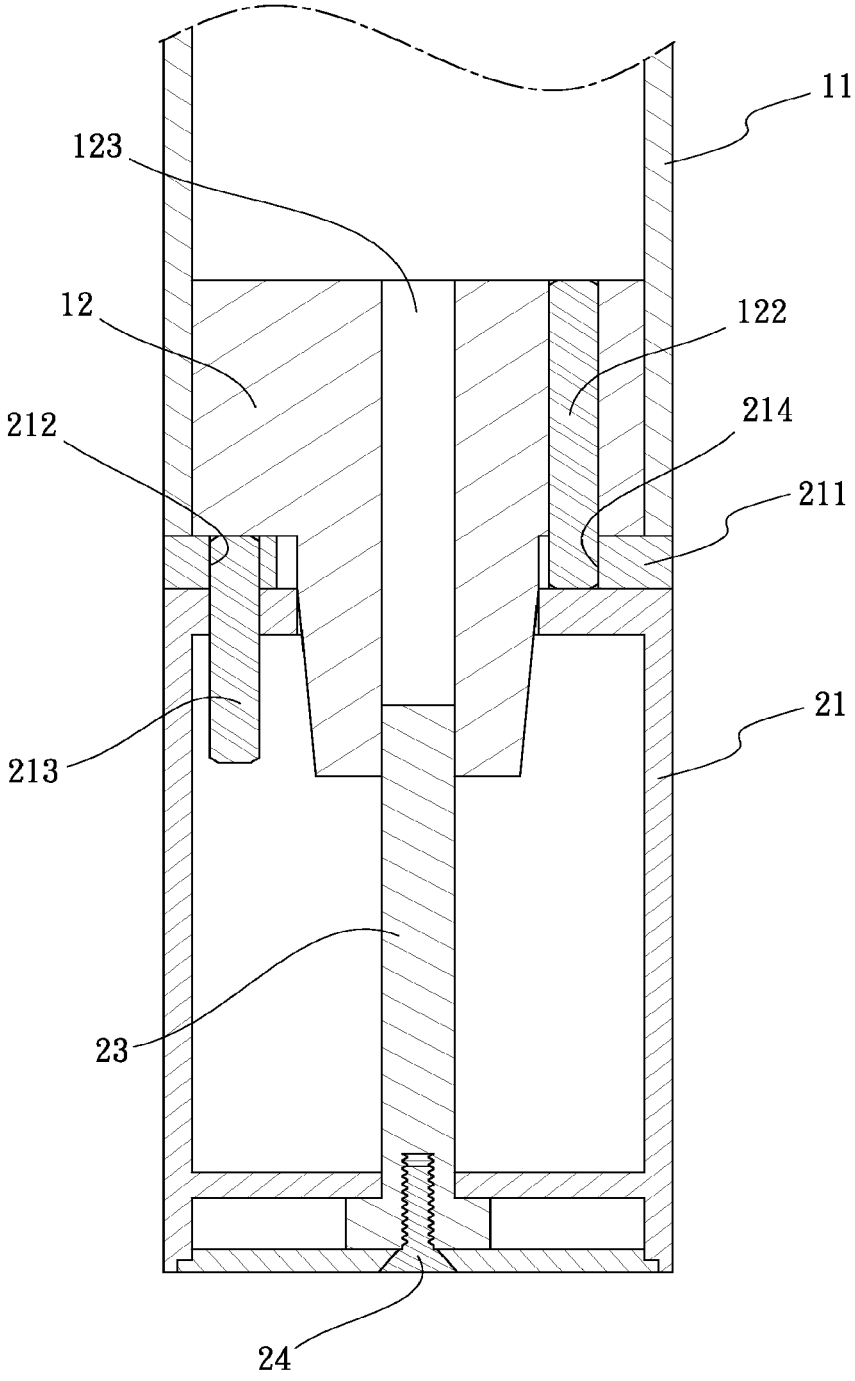
FIG. 3A is a partial cross-sectional view of the table leg assembly along line 3A-3A of FIG. 3.
Figure 4A:
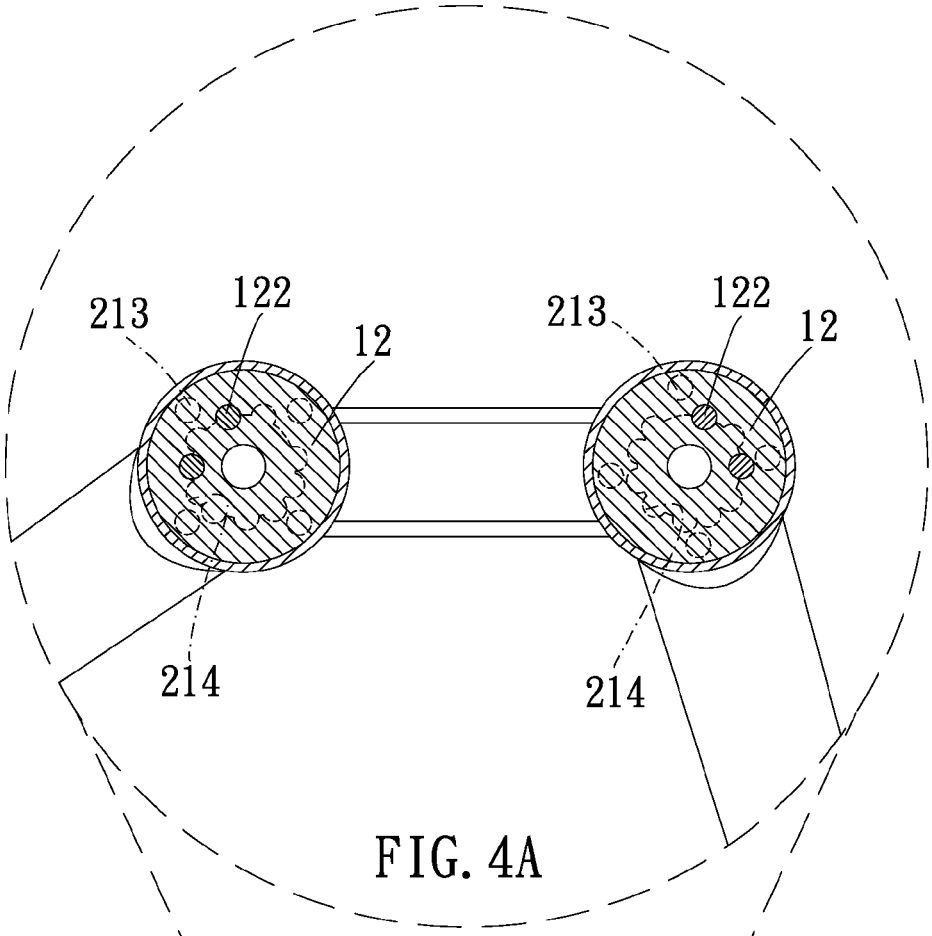
FIG. 4A, FIG. 5A and FIG. 6A are partially enlarged views of the table leg assembly, showing the relationship between a plurality of positioning pins, positioning holes and pins.
Figure 4:
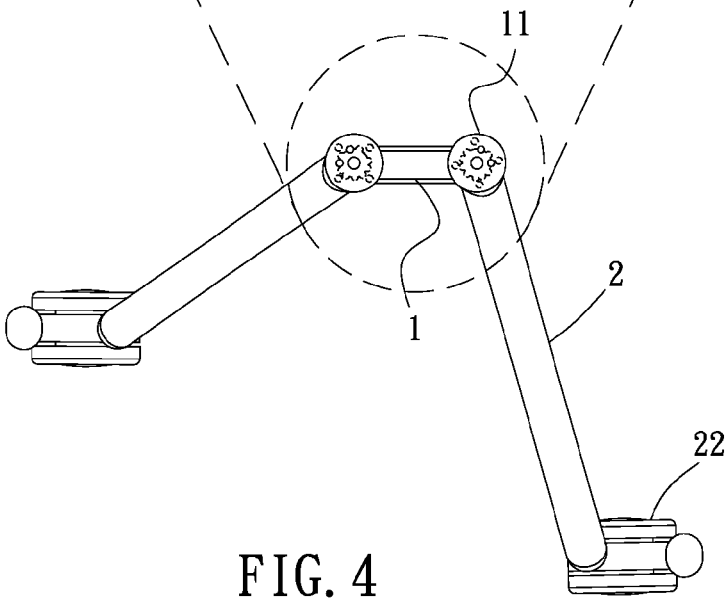
FIG. 4, FIG. 5 and FIG. 6 are top plane views of the table leg assembly, showing the different angles between two branch legs.
Figures 5, 5A:
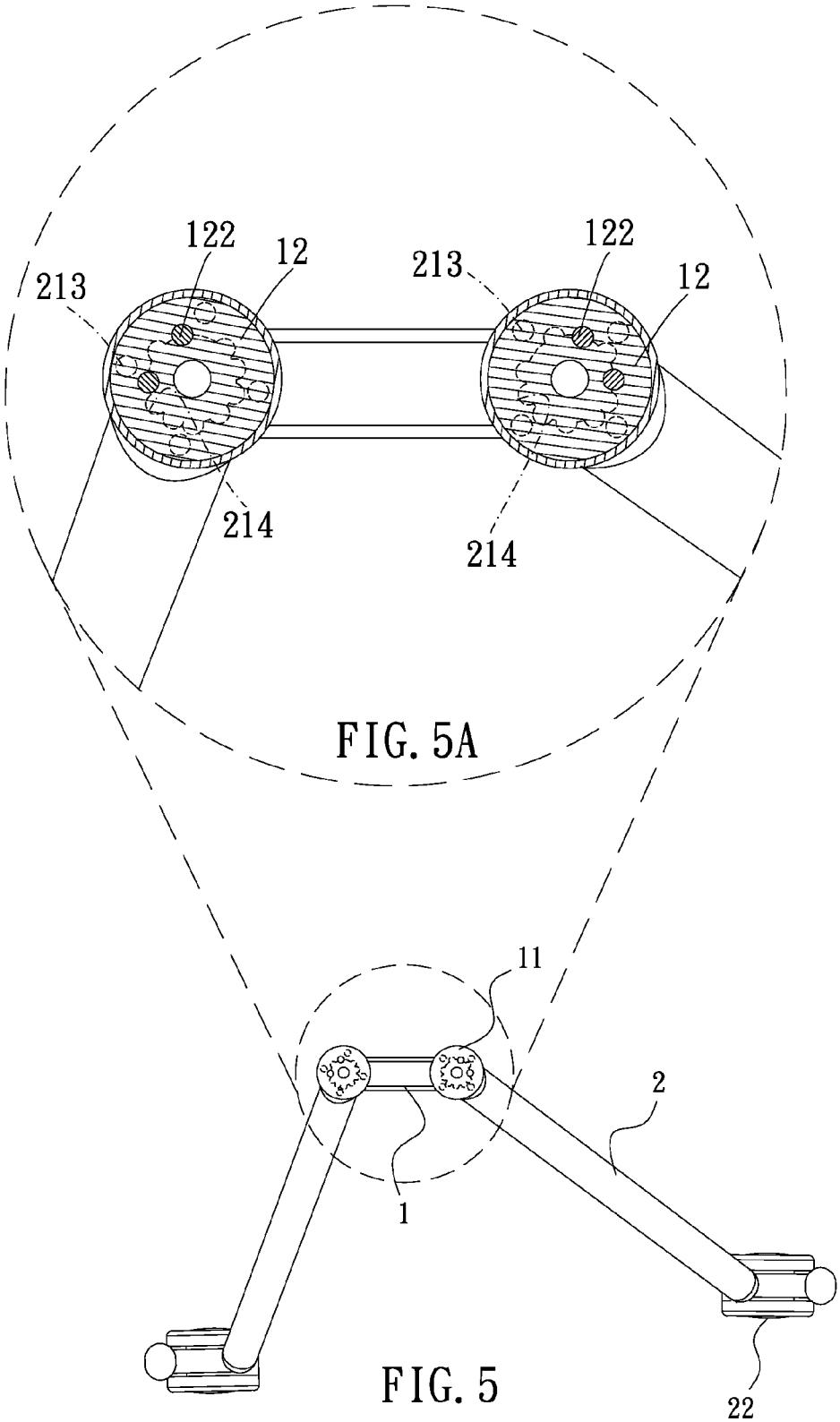
Figure 6A:
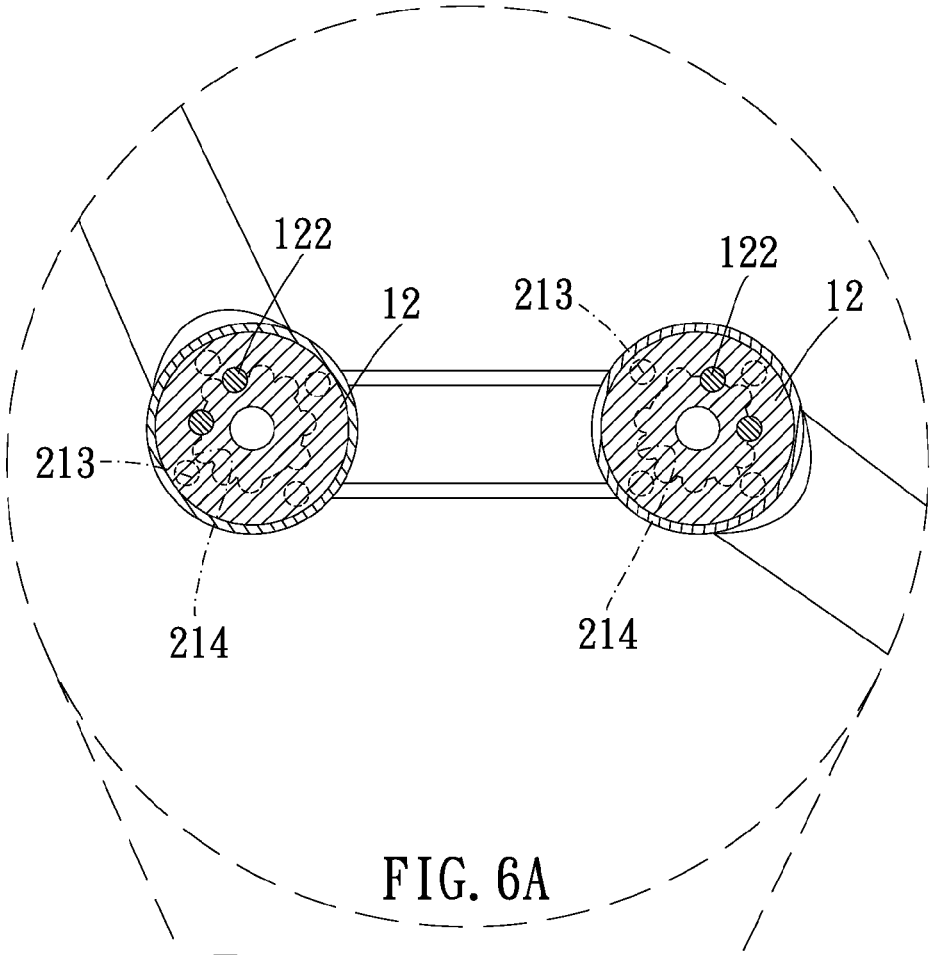
Figure 6:
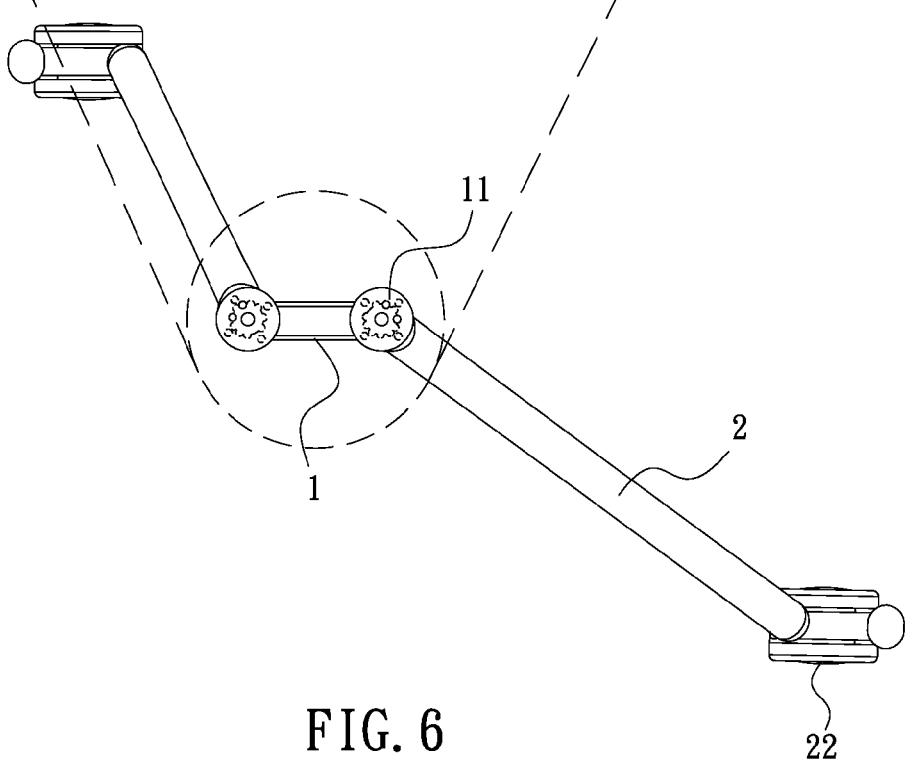

The table leg assembly in accordance with the present invention further comprises two connecting pins 23 and a joint plate 3. Referring to FIG. 1 and FIG. 3A, each connecting pin 23 passes through the cylinder 21 of the respective branch leg 2 and the ring 211 and is plugged into the through hole 123 in the joint member 12 such that the respective branch leg 2 is firmly connected to the upright leg 1. The joint plate 3 is disposed under the cylinders 21 of the two branch legs 2. Two screws 24 pass through the joint plate 3 and respectively screw into the two connecting pins 23 for securing the two branch legs 2 and enhancing the rigidity of the table leg assembly.

Furthermore, an upper connecting portion 13 is disposed in between the two tubes 11 of the upright leg 1 for securing the two tubes 11 steadily. 1n addition, a lower connecting portion 25 is disposed in between the two cylinders 21 of the two branch legs 2 for retaining the two cylinders 21 spaced apart in a distance, as shown in FIGS. 1 and 3.

Referring to FIGS. 4-6 and FIGS. 4A-6A, the different angles between two branch legs 2 are illustrated. When a user wants to adjust the angle between the two branch legs 2, the user detaches the joint plate 3 from the two connecting pins 23 and further detaches each connecting pin 23 from the respective cylinder 21 (as shown in FIG. 1); then, the user detaches the cylinder 21 of each branch leg 2 from the respective tube 11 of the upright leg 1; thereafter, the user could rotates each branch leg 2 to a certain angle and fixed by the position pin 122 so that the angle between the two branch legs 2 is adjusted; finally, the user attaches each connecting pin 23 back to the each cylinder 21 and further attaches the joint plate 3 back to the two connecting pins 23 (as shown in FIG. 3). Therefore, the user can adjust the angle to fit their need. The table leg assembly in accordance with the present invention can fit different placing environments.

Figure 7:
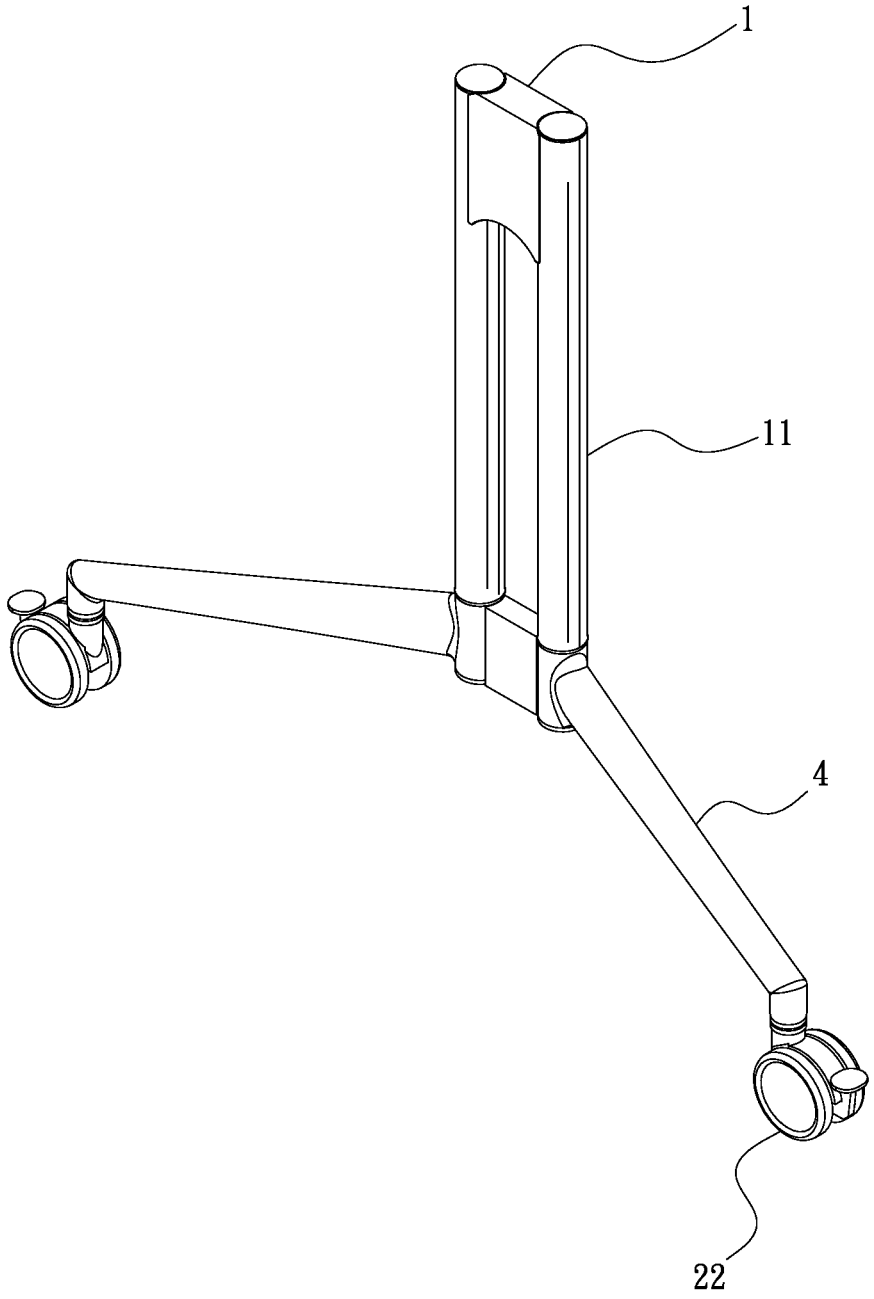
FIG. 7 is an assembled perspective view of a second embodiment of a table leg assembly in accordance with the present invention.

Referring to FIG. 7, a second embodiment of a table leg assembly in accordance with the present invention is illustrated. The elements and effects of the second embodiment which are the same with the first embodiment are not described, only the differences are described. The branch leg 4 of the second embodiment is longer than the branch leg 2 of the first embodiment for providing more stability than the first embodiment.

Although the invention has been explained in relation to its preferred embodiment, it is to be understood that many other possible modifications and variations can be made without departing from the spirit and scope of the invention as hereinafter claimed.

What is claimed is:

1. A table leg assembly comprising:

an upright leg having two tubes longitudinally extended therefrom, each tube having a joint member plugged into a lower end thereof, the joint member having a post extending from one end thereof;

two branch legs connected to the upright leg, each branch leg having a cylinder formed at one end thereof, the cylinder being coaxially aligned with the respective tube of the upright leg, a ring positioned on a top of the cylinder, the ring having a plurality of positioning grooves defined around an inner periphery thereof; wherein the post of the joint member passes through the ring and is received in a receiving hole of the cylinder so that each branch leg is rotatable relative to the respective tube of the upright leg;

at least one positioning pin passing through the joint member and positioned in one of the positioning grooves of the ring so as to restrict the respective branch leg in a certain angle; and two connecting pins, each connecting pin passing into the cylinder of the respective branch leg and the ring and plugged into a through hole of the joint member for firmly connecting the respective branch leg and the respective tube of the upright leg.

2. The table leg assembly as claimed in claim 1 further comprising a joint plate disposed under the cylinders of the two branch legs, and two screws passing through the joint plate and screwed into the two connecting pins for securing the two branch legs.

3. The table leg assembly as claimed in claim 1, wherein each branch leg has a roller disposed in one end thereof opposite to the cylinder.

4. The table leg assembly as claimed in claim 1, wherein the ring has a plurality of through holes annularly defined therein, and a plurality of pins is inserted in the through holes of the ring to secure the ring on the top of the cylinder of the respective branch leg.

* * * * *